US008568188B2

(12) United States Patent
Horowitz et al.

(10) Patent No.: US 8,568,188 B2
(45) Date of Patent: Oct. 29, 2013

(54) TRACK SEGMENTS PROVIDING A CONVOLUTED PATH

(76) Inventors: Victor Horowitz, Oceanside, NY (US); Judith Horowitz, Oceanside, NY (US)

( * ) Notice: Subject to any disclaimer, the term of this patent is extended or adjusted under 35 U.S.C. 154(b) by 423 days.

(21) Appl. No.: 12/914,156

(22) Filed: Oct. 28, 2010

(65) Prior Publication Data

US 2012/0108139 A1 May 3, 2012

(51) Int. Cl.
*A63H 29/08* (2006.01)

(52) U.S. Cl.
USPC ..... 446/168; 446/85; 446/92; 446/129; 273/120 R

(58) Field of Classification Search
USPC ..... 446/92, 444, 168–174, 85, 129; 273/120 R
See application file for complete search history.

(56) References Cited

U.S. PATENT DOCUMENTS

| | | | | | |
|---|---|---|---|---|---|
| 1,826,215 | A * | 10/1931 | Hutchison | ..... | 273/120 R |
| 3,314,169 | A * | 4/1967 | Wold | ..... | 434/189 |
| 4,553,749 | A * | 11/1985 | Bender et al. | ..... | 446/168 |
| 5,007,876 | A * | 4/1991 | Klitsner | ..... | 446/168 |
| 5,021,021 | A * | 6/1991 | Ballard | ..... | 446/92 |
| D349,528 | S * | 8/1994 | Ruszkai | ..... | D13/158 |
| 5,344,143 | A * | 9/1994 | Yule | ..... | 273/118 R |
| 5,908,343 | A * | 6/1999 | Rothbarth et al. | ..... | 446/171 |
| 5,944,575 | A * | 8/1999 | Tolnay | ..... | 446/168 |
| 6,056,620 | A * | 5/2000 | Tobin | ..... | 446/168 |
| 6,340,323 | B1 * | 1/2002 | Glynn | ..... | 446/168 |
| 6,431,936 | B1 * | 8/2002 | Kiribuchi | ..... | 446/92 |
| 6,500,007 | B2 * | 12/2002 | Pupulin | ..... | 446/115 |
| 6,536,763 | B1 * | 3/2003 | Braun | ..... | 446/168 |
| 6,638,134 | B1 * | 10/2003 | Hewitt | ..... | 446/168 |
| 7,722,431 | B2 * | 5/2010 | Sullivan et al. | ..... | 446/486 |
| 2010/0056013 | A1 * | 3/2010 | Kaplan | ..... | 446/92 |
| 2011/0070803 | A1 * | 3/2011 | Hoffman et al. | ..... | 446/168 |

* cited by examiner

*Primary Examiner* — Gene Kim
*Assistant Examiner* — Urszula M Cegielnik
(74) *Attorney, Agent, or Firm* — Cowan, Liebowitz & Latman, P.C.; Mark Montague; Serge Krimnus

(57) ABSTRACT

A series of spaced apart track segments provide a path for the rolling of a marble from beginning to end. The track segments have a magnetic strip attached to one outer surface so that they can be mounted on a ferromagnetic wall such as a door or sidewalls or refrigerator. This provides for a user the ability to configure a wide variety of pathways for a rolling marble and to include on that pathway certain gaps.

14 Claims, 4 Drawing Sheets

TRACK SEGMENTS PROVIDING A CONVOLUTED PATH

BACKGROUND OF INVENTION

This invention relates in general to the design of a plurality of longitudinal segments that can be used to build a track on which a marble can roll from beginning to end over a convoluted path.

Devices are known to permit a user to build a convoluted track out of segments which are assembled by the user to provide a path for a marble which path, in large part, is determined by the user. One such known device uses Velcro as a means for attaching the tracks to a background support so that a complex track can be built by the user to permit a marble to roll from an upper end to a lower end of the path built from the segments.

An earlier design provided this complex path type of device except that the tracks or segments are fastened into a predetermined track cut into the background panel on which the operative track is supported. This fixed track design provided no leeway for the user's imagination. The Velcro backed track did permit the user to control the track design and path. In the Velcro type design, adjustments in the path designed by the user are difficult to make because the segments have to be lifted off of the support backing and placed back by fastening the track onto the Velcro backing. This made adjustments difficult and was frustrating for the user in terms of the ability of the user to experiment and to refine a design.

A major purpose of this invention is to provide the user with improved facility in designing a wide variety of pathways for a marble to roll from beginning to end.

Related to this purpose, is the purpose of a design for maintaining the marble on the track and for assuring that the marble leaves each track segment in a predetermined fashion to assure that it can be picked up by or can fall onto an adjacent track segment.

A further purpose of this invention is to provide these improvements in a device that is inexpensive so that it will readily be acceptable as an improved substitute for the presently known devices.

BRIEF DESCRIPTION

In one embodiment, a series of linear track segments are provided. One subset of these track segments is approximately V-shaped in cross-section. Another subset is approximately U-shaped in cross-section having opposed sidewalls separated by a base wall. In all cases, the walls of each are connected to one another along longitudinal edges thereof.

A magnetic tape is attached to the outside surface of one of the walls of each segment so that the segment can be mounted on a ferromagnetic backing such as provided by the door or sidewalls of a refrigerator.

The segment wall that carries the magnetic strip and the adjacent wall of the same segment have an angular relationship that is approximately 80 degrees so that the marble will be biased against the wall having the magnetic strip. Thus the marble will come off of each segment in a predetermined manner so that it will be appropriately caught by a properly placed next segment.

The ends of the segments are normally spaced from one another to provide a path in which the marble traverses the gap between segments.

Deployment of these segments against a vertical ferromagnetic surface, such as the wall of a refrigerator, can provide a convoluted path along which a marble can be rolled from a start point to an end point.

THE FIGURES

FIG. 5 is how a set of segments might be deployed when mounted on the vertical surface of, for example, a refrigerator.

DETAILED DESCRIPTION

The Figures all relate to the same embodiment.

Figure 1:
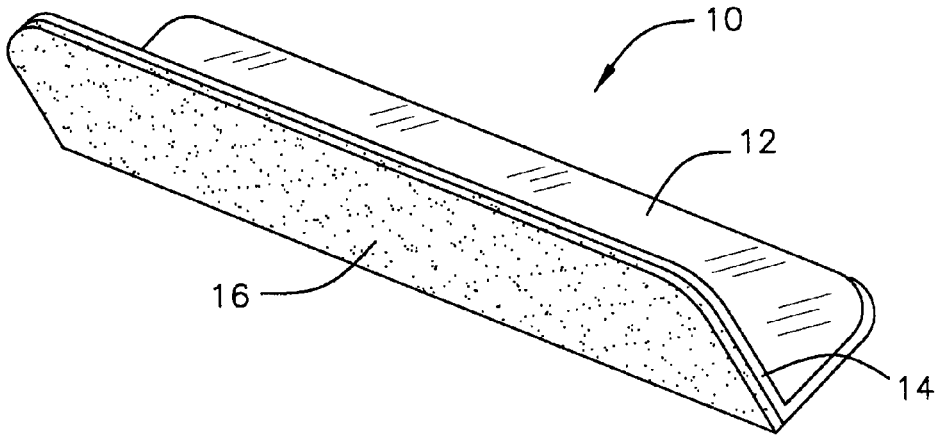
FIG. 1 is a perspective view of the of the approximately V-shaped segment.

FIG. 1 is a perspective view of an approximately V-shaped longitudinal segment 10 having walls 12 and 14. The walls are connected to one another along a longitudinal edge. Wall 14 has a magnetic strip 16 affixed to the outer surface thereof. In this embodiment, the angle between the two walls 12 and 14 is 80 degrees in this embodiment.

Figure 2:
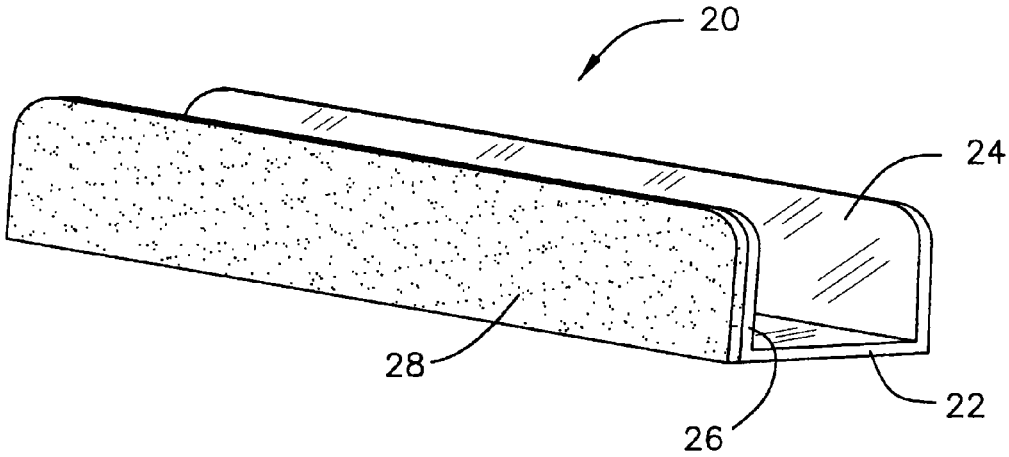
FIG. 2 is a perspective view of the approximately U-shaped segment.
Figure 3:
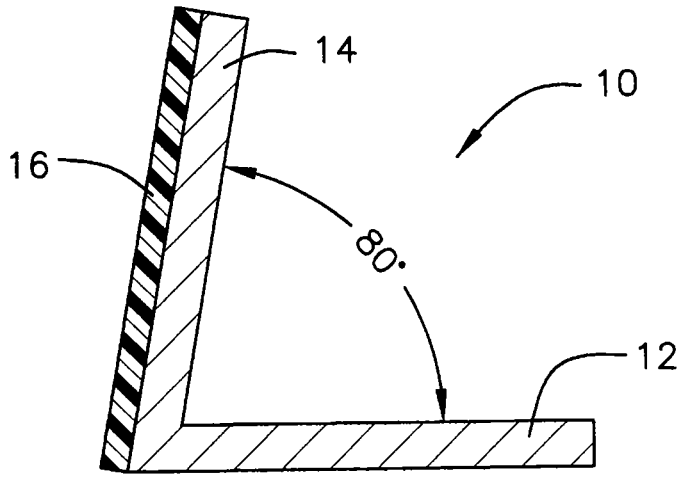
FIG. 3 is a cross-section of FIG. 1.
Figure 4:
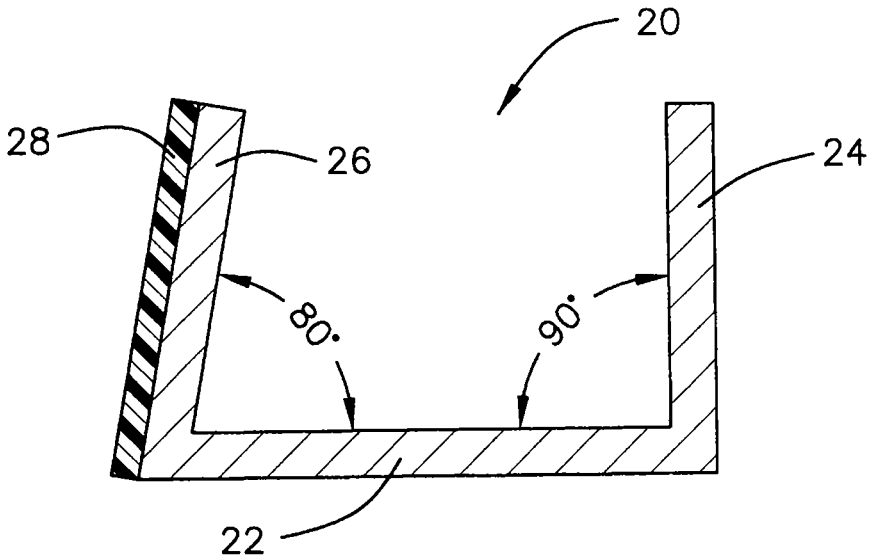
FIG. 4 is a cross-section of FIG. 2.

FIG. 2 shows an approximate U-shaped longitudinal segment 20 having a base wall 22 and two sidewalls 24 and 26. The wall 26 has a magnetic strip 28 affixed to the outer surface thereof. The angle between the wall 26 on which the magnetic strip is affixed and the base 22 is approximately 80 degrees in this example. When the segments 10 and 20 are mounted on a magnetic surface, a wide variety of paths can be made to accept a marble rolling from a start position to an end position.

Figure 5:
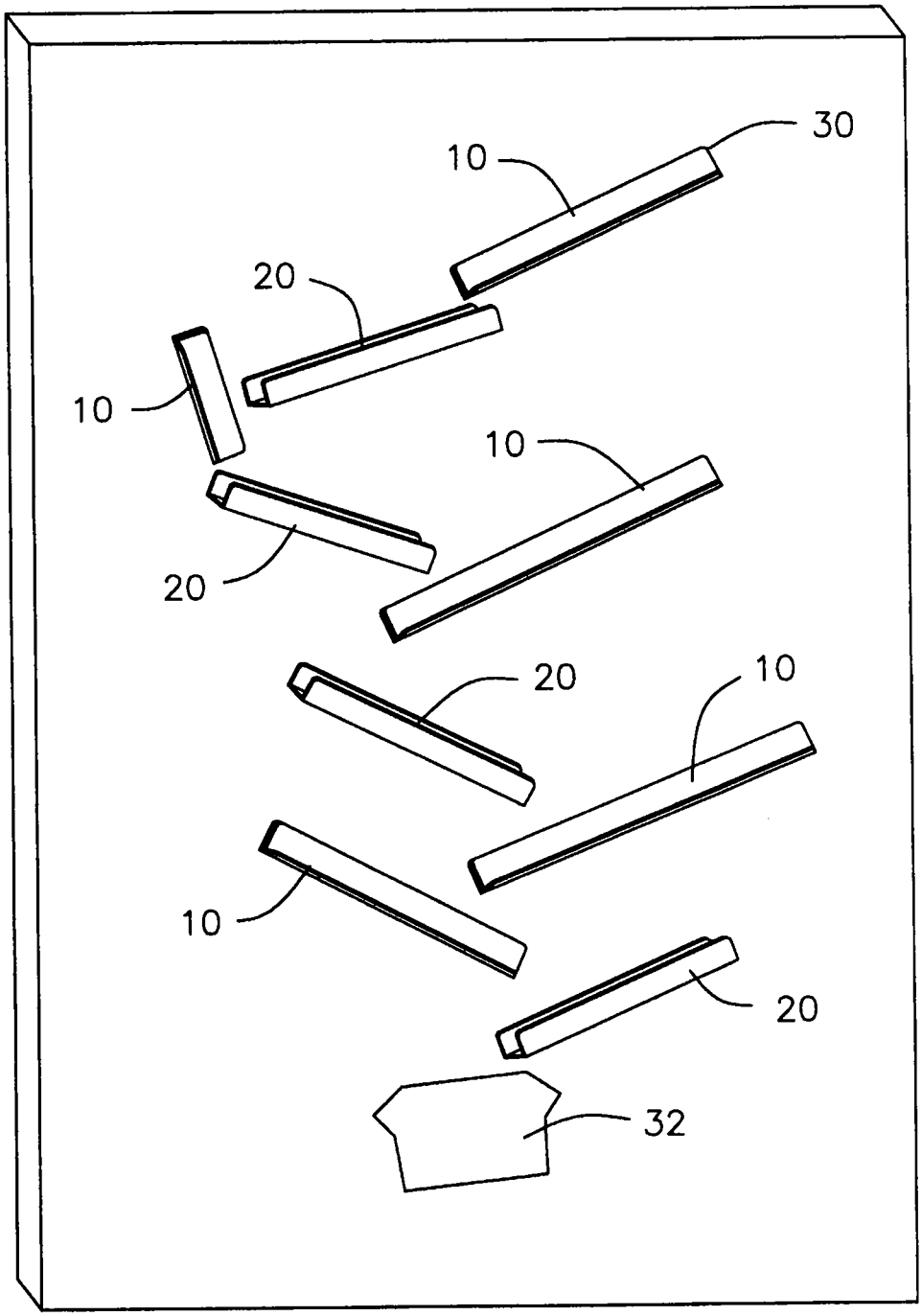
FIG. 5 is a view of a first configuration or deployment of segments defining a pathway for a rolling marble.
Figure 6:
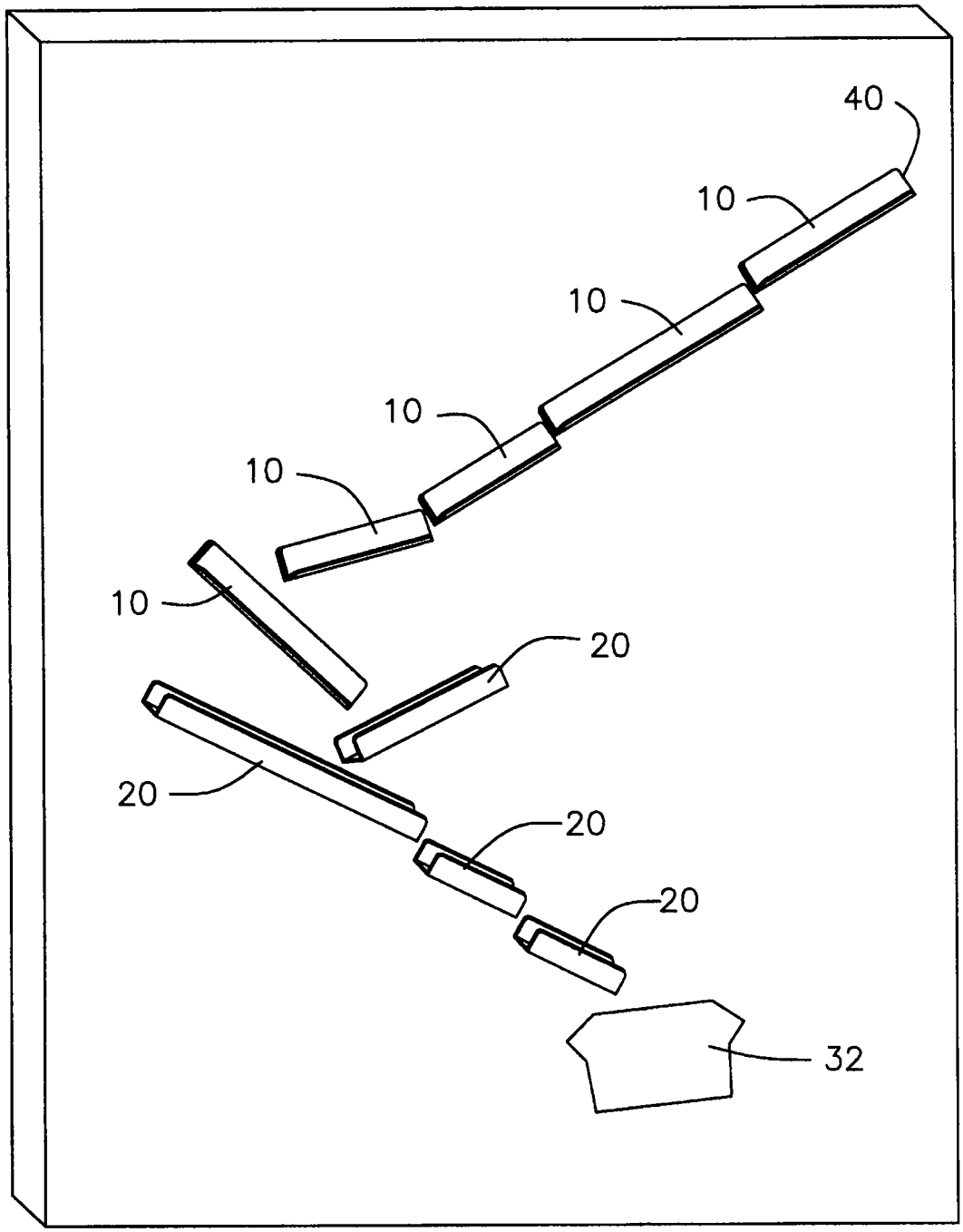
FIG. 6 is similar to FIG. 5 except that it shows a second deployment of segments forming a second pathway.

FIGS. 5 and 6 illustrate two sets of possible arrangements. In FIG. 5, the marble (not shown) can be rolled through the convoluted path by being placed at the starting point 30 to roll through the various segment paths to be received in a box 32. In the FIG. 5 arrangement, there are both V-shaped path segment 10 and U-shaped path segment 20. FIG. 6 shows a second arrangement also comprising both V-shaped path 10 and U-shaped path 20 in which a marble can be rolled from the starting point 40 through the various segment paths to the box 32.

It might be noted in the FIG. 5 arrangement that one of the V-shaped segments 10 is arranged so that one of its walls blocks the marble from coming out of the top of the adjacent U-shaped segment 20. The use of such a stop increases the variability in the size and positioning of the gap between the immediately upstream segment and immediately downstream segment.

In a presently preferred embodiment, the angle between the wall on which the magnetic tape is mounted and the adjacent wall is 80 degrees in both the V-shaped and U-shaped segments. In the U-shaped segment, the base wall is at approximately 90 degrees to the wall that does not carry the magnetic strip.

The 80 degree relationship between the wall carrying the magnetic tape and the adjacent wall is employed in connection with both V-shaped segments and U-shaped segments. In one embodiment, the walls of the V-shaped segment are approximately ¾ of an inch wide as is the base wall of the U-shaped segment. In the U-shaped segment, the height of the sidewalls and the width of the base wall are each ¾ of an inch. The segments are approximately 1/16 of an inch thick. It should be understood that these dimensions can be varied appreciably and still obtain the results. For example, the segments disclosed are all linear. They could be curved longitudinal segments to provide curved path portions. The segments employed in the embodiments shown have varying lengths from two to ten inches.

What is claimed is:

1. A set of segments for building a complex track for guiding a marble comprising:

a plurality of longitudinal segments having at least first and second walls joined to one another along a longitudinal edge of each, a magnetic strip on the outer surface of said first wall of each of said segments to permit mounting said segments on a ferromagnetic surface, the angle between said first and second walls being sufficiently less than 90 degrees to hold whatever marble is rolled along said linear against said first wall, members of said set of said segments having variable lengths, said magnetic strip providing a magnetic attraction low enough to permit manual fine adjustment while continuing to maintain contact with whatever surface is used as the backing for the segment, whereby the user can arrange said segments in a complex pattern, each segment being in communication with one or two other segments to provide a multi-segment complex path for a rolling marble, wherein said magnetic strip is a same length and height as said first wall of each of said segments, and wherein said magnetic strip is flush with said first wall of each of said segments.

2. The set of segments of claim 1 wherein:

said plurality of segments comprises first and second subsets, said first subset having a generally V-shaped cross section, said second subset having a generally U-shaped cross section and a third wall spaced from said first wall by said second wall.

3. The set of segments of claim 1 wherein each of said segments is linear.

4. The set of segments of claim 2 wherein each of said segments is linear.

5. A set of segments for building a complex track for guiding a marble, consisting of:

a plurality of longitudinal segments, a first set of said segments, each segment having first and second longitudinal walls joined to one another along a longitudinal edge of each, a second set of said segments, each segment of said first set having first and second longitudinal sidewalls spaced from one another by a base wall, said base wall joined to said sidewalls along the longitudinal edges thereof, a magnetic strip on the outer surface of said first one of said walls of each of said first and second sets of segments to permit mounting said segments on a ferromagnetic surface, the angle between said first wall and the adjacent wall of each of said segments being sufficiently less than 90 degrees to hold whatever marble is rolled against said first wall, members of said sets of segments having variable lengths, said magnetic strip providing a magnetic attraction low enough to permit manual fine adjustment movement of a segment on whatever surface is used as the backing for the segment without removing said segment from said backing surface, whereby the user can arrange said segments in a complex pattern, each segment being in communication with one or two other segments to provide a multi-segment complex path for a rolling marble, wherein said magnetic strip is a same length and height as said first one of said walls of each of said first and second sets of segments, and wherein said magnetic strip is flush with said first one of said walls of each of said first and second sets of segments.

6. The set of segments of claim 5 wherein: said first set has a generally V-shaped cross section and said second set has a generally U-shaped cross section.

7. The set of segments of claim 5 wherein each of said segments is linear.

8. The set of segments of claim 6 wherein each of said segments is linear.

9. The set of segments of claim 1, wherein said plurality of segments comprises first and second subsets, said first subset having a generally V-shaped cross section, said second subset having a generally U-shaped cross section, and wherein a segment having the generally V-shaped cross-section is arranged so that one of its walls blocks the rolling marble from out of the top of an adjacent segment having the generally U-shaped cross-section.

10. The set of segments of claim 1, wherein said plurality of segments comprises first and second subsets, said first subset having a generally V-shaped cross section, said second subset having a generally U-shaped cross section, and wherein walls of a segment having the generally V-shaped cross section are approximately ¾ of an inch.

11. The set of segments of claim 1, wherein said plurality of segments comprises first and second subsets, said first subset having a generally V-shaped cross section, said second subset having a generally U-shaped cross section, and wherein walls of each of the segments are approximately 1/16 of an inch thick.

12. The set of segments of claim 1, wherein said plurality of segments comprises first and second subsets, said first subset having a generally V-shaped cross section, said second subset having a generally U-shaped cross section, and wherein an angle between walls of a segment having the generally V-shaped cross-section is 80°.

13. The set of segments of claim 1, wherein said plurality of segments comprises first and second subsets, said first subset having a generally V-shaped cross section, said second subset having a generally U-shaped cross section, and wherein an angle between a wall carrying a magnetic strip and a base wall of a segment having the generally U-shaped cross-section is approximately 80° and wherein an angle between a wall not carrying a magnetic strip and the base wall of a segment having the generally U-shaped cross-section is approximately 90°.

14. A set of segments for building a complex track for guiding a marble comprising:

a plurality of longitudinal segments, a first set of said segments, each segment having first and second longitudinal walls joined to one another along a longitudinal edge of each, a second set of said segments, each segment of said first set having first and second longitudinal sidewalls spaced from one another by a base wall, said base wall joined to said sidewalls along the longitudinal edges thereof, a magnetic strip on the outer surface of said first one of said walls of each of said first and second sets of segments to permit mounting said segments on a ferromagnetic surface, the angle between said first wall and the adjacent wall of each of said segments being sufficiently less than 90 degrees to hold whatever marble is rolled against said first wall, members of said sets of segments having variable lengths, said magnetic strip providing a magnetic attraction low enough to permit manual fine adjustment movement of a segment on whatever surface is used as the backing for the segment without removing said segment from said backing surface, whereby the user can arrange said segments in a complex pattern, each segment being in communication with one or two other segments to provide a multi-segment complex path for a rolling marble, wherein said magnetic strip is a same length and height as said first one of said walls of each of said first and second sets of segments, and wherein said magnetic strip is flush with said first one of said walls of each of said first and second sets of segments.

* * * * *